US005529240A

United States Patent [19]

Harris

[11] Patent Number: 5,529,240

[45] Date of Patent: Jun. 25, 1996

[54] CARTON BOTTLE PARTITION

[75] Inventor: Randall L. Harris, Powder Springs, Ga.

[73] Assignee: Riverwood International Corporation, Atlanta, Ga.

[21] Appl. No.: 292,503

[22] Filed: Aug. 18, 1994

[51] Int. Cl.[6] ..... B65D 25/04

[52] U.S. Cl. ..... 229/120.27; 229/120.37

[58] Field of Search ..... 229/120.26, 120.27, 229/120.24, 120.38, 120.37, 120.14

[56] References Cited

U.S. PATENT DOCUMENTS

| | | | |
|---|---|---|---|
| 3,662,879 | 5/1972 | Helms | 229/120.27 X |
| 3,982,684 | 9/1976 | David | 229/120.26 |
| 3,997,102 | 12/1976 | Jones | 229/120.26 |
| 4,155,501 | 5/1979 | Young | 229/120.26 |
| 4,226,357 | 10/1980 | Martin | 229/120.26 |
| 4,249,691 | 2/1981 | Gardner | 229/120.26 |
| 4,583,677 | 4/1986 | Neese et al. | 229/120.26 |

*Primary Examiner*—Allan N. Shoap
*Assistant Examiner*—Christopher J. McDonald

[57] ABSTRACT

A partition for separating bottles in a carton. The partition is formed from a unitary blank having fold lines designed to form a short leg connected to parallel long legs. Bottle separating wings are connected to the legs along fold lines so as to extend out at right angles to the legs, with some of the wings extending out on opposite sides of the leg to which they are connected. Irregular edges of the wings enable portions of the wings to extend out a distance slightly greater than the distance between the long legs so as to ensure that the wings extend beyond the midpoint of adjacent bottles.

11 Claims, 3 Drawing Sheets

CARTON BOTTLE PARTITION

FIELD OF THE INVENTION

This invention relates to partitions for separating bottles in a carton. More particularly, it relates to a partition of unitary construction.

BACKGROUND OF THE INVENTION

Paperboard partitions are used to separate adjacent bottles in a carton or carrier to prevent the bottles from contacting each other. This protects against breakage due to vibration and shock during shipping and handling. Typically, a partition adapted to separate the bottles of two adjacent rows will consist of a long panel situated between the rows and transverse cross pieces which extend out from the panel between adjacent bottles in each row. Partitions P of this type are shown in the prior art illustration of FIG. 1 wherein two such partitions are employed in a package of twelve bottles B to separate the bottles in the outer rows from each other. A straight partition or divider D is employed to separate the inner two rows of bottles. In forming a carton of this type the three partitions have to be separately inserted into the group of bottles, requiring the packaging machine to have three partition inserting sections.

Some carriers employ an integral center keel connected to the top panel instead of a separate center divider D. Even with such an arrangement the outer two partitions still have to be separately inserted. Also, additional partition units are required as the number of bottles in a carton increases. For example, a carrier for twenty-four bottles requires five partitions, which means that the packaging machine must have five partition inserting sections.

Since the number of partition inserting sections required in a packaging machine increases with the number of partitions in a carton, machines designed to package larger numbers of bottles can become quite expensive. The additional partition inserting sections can also increase the length of the machine to a point which is too long or impractical to install in an existing packaging plant.

It would be highly desirable and beneficial to be able to utilize bottle partitions which do not require a packaging machine to have as many different partition inserting sections as presently is required. It would also be desirable if the cost of partitions in a carton could be reduced.

BRIEF SUMMARY OF THE INVENTION

The bottle partition of the invention is comprised of two spaced substantially parallel partition legs connected along fold lines to a transverse partition leg. Partition wings are connected to each of the fold lines, some extending substantially parallel to the transverse partition leg and some substantially parallel to the spaced partition legs. The partition wings extending substantially parallel to the transverse partition leg are struck from the spaced partition legs, and the partition wings extending substantially parallel to the spaced partition legs are struck from the transverse partition leg. The partition is inserted in a group of bottles so that the spaced legs and the partition wings parallel to the spaced legs separate an interior row of bottles from adjacent rows, with the wings parallel to the transverse leg separating bottles within the adjacent rows.

Additional partition wings foldably connected to each spaced partition leg may extend substantially parallel to the transverse partition leg to separate other bottles within the rows. One or more of the partition wings extend both outwardly and inwardly of the partition leg to which the wing is connected so as to extend into two adjacent rows. The partition wings extend out from the leg to which they are connected a distance equal to at least half the distance between the spaced parallel legs to ensure that they separate adjacent bottles at their points of greatest diameter.

A four-sided partition may be provided instead of a three-sided partition by adding an opposite transverse partition leg and associated wings.

The invention not only reduces the number of partition inserting sections required in a packaging machine and reduces the cost of the partitions themselves, but includes other aspects and benefits which will be readily apparent from the more detailed description of the preferred embodiments which follows.

DETAILED DESCRIPTION OF THE PREFERRED EMBODIMENTS

Figure 1:
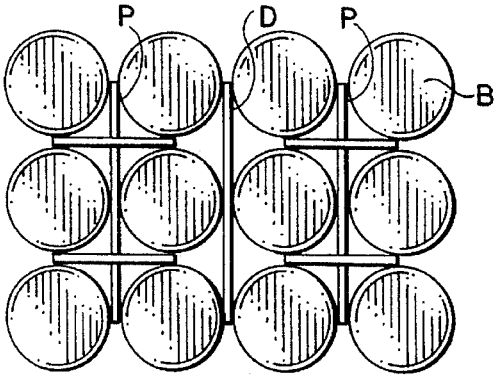
FIG. 1 (PRIOR ART)
FIG. 1 is a simplified plan view of a typical prior art partition arrangement for use in a carton designed to hold twelve beverage bottles.
Figure 2:
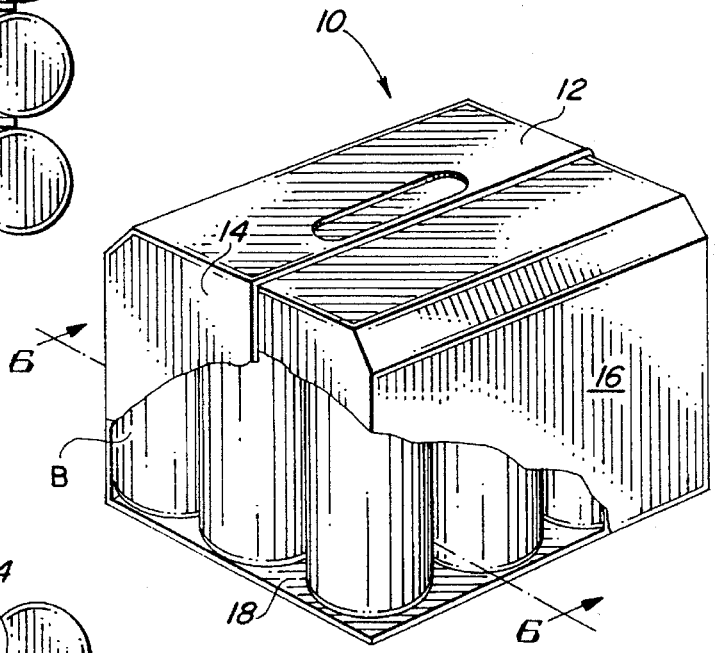
FIG. 2 is a pictorial view-of a carton incorporating the partitions of the present invention, with portions of the carton being cut away to reveal the packaged bottles.

Referring to FIG. 2, the carton 10 includes top panel 12 connected to end and side panels 14 and 16, respectively, both of which are connected to bottom panel 18. The carton is not intended to illustrate any particular design, but is merely representative of a carton adapted to hold twelve beverage bottles. Separating the bottles in the carton is the partition of the invention, which is not visible in this view.

Figure 3:
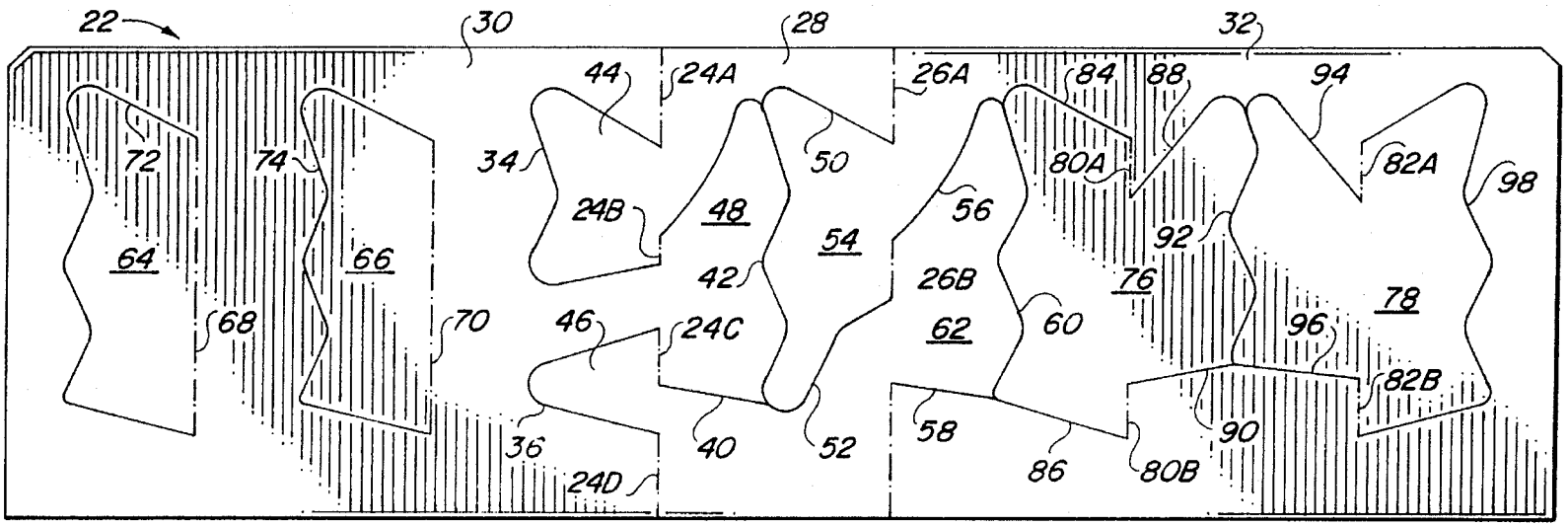
FIG. 3 is a plan view of a blank for forming one embodiment of the partition of the invention.

A blank 22 for forming the partition is shown in FIG. 3 to comprise a rectangular sheet of paperboard divided by parallel fold lines 24 and 26 into a central short leg section 28 and end long leg sections 30 and 32. The fold lines are discontinuous, with the ends of the fold line segments being connected by slits. Thus the lower end of fold line segment 24A is connected to the lower end of segment 24B by the slit 34 and the upper end of fold line segment 26C is connected to the upper end of segment 24D by slit 36. Slits 38 and 40, respectively, connect the upper end of fold line segment 24B and the lower end of fold line segment 24C to slit 42. The areas extending from the central section 28 defined by the slits 34 and 36 form partition wings 44 and 46, respectively, while the area extending from the end section 30 defined by the slits 38, 40 and 42 define partition wing 48. Similarly, slits 50 and 52, extending from the lower ends of fold line segments 26A and 26B, form with slit 42 the partition wing 54. Additionally, slits 56 and 58, extending from the upper ends of fold line segments 26B and 26C, form with slit 60 the partition wing 62.

Identical single partition wings 64 and 66 are formed in the end section 30 by parallel fold lines 68 and 70 which are connected by continuous slits 72 and 74, respectively. Identical double partition wings 76 and 78 are formed in the end section 32 by discontinuous parallel fold lines 80 and 82 with connecting slits. Thus slits 84 and 86, extending from the upper and lower ends, respectively, of the fold line segments 80A and 80B, form with slit 60 half of the wing 76, while slits 88 and 90, extending from the other ends of the same fold line segments form with slit 92 the other half of the wing 76. The double wing 78 is similarly formed by the fold line segments 82A and 82B which correspond to the fold line segments 80A and 80B, slits 94 and 96 which correspond to slits 88 and 90, and continuous slit 98 which corresponds to combined slits 60, 84 and 86.

A partition is formed by folding the blank 22 along the fold lines 24 and 26 so that the end sections 30 and 32 form right angles with the central section 28. As shown best in FIG. 4, this results in creating two long partition legs 30 and 32 and a short end partition leg 28. During the folding step the partition wings 44, 46 and 62 remain integrally connected to the end partition leg 28 so that they extend out at right angles to the partition legs 30 and 32, with the vertically spaced wings 44 and 46 functioning as a single partition wing. In the same manner, the partition wings 48 and 54 remain integrally connected to the long partition legs 30 and 32 so that they extend out from the partition leg 28. The partition wings 44, 46, 62, 48 and 54 thus are automatically opened to their operative positions by the folding step described. To open the remaining wings it is merely necessary to fold the single wings 64 and 66 out about their fold lines 68 and 70 and to fold the double wings 76 and 78 about their fold lines 80 and 82.

Figure 5:
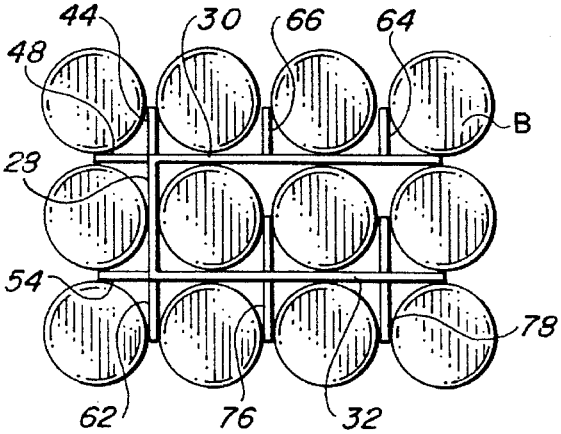
FIG. 5 is a simplified plan view of the arrangement utilizing the partition of FIG. 4 to separate a group of twelve bottles.
Figure 4:
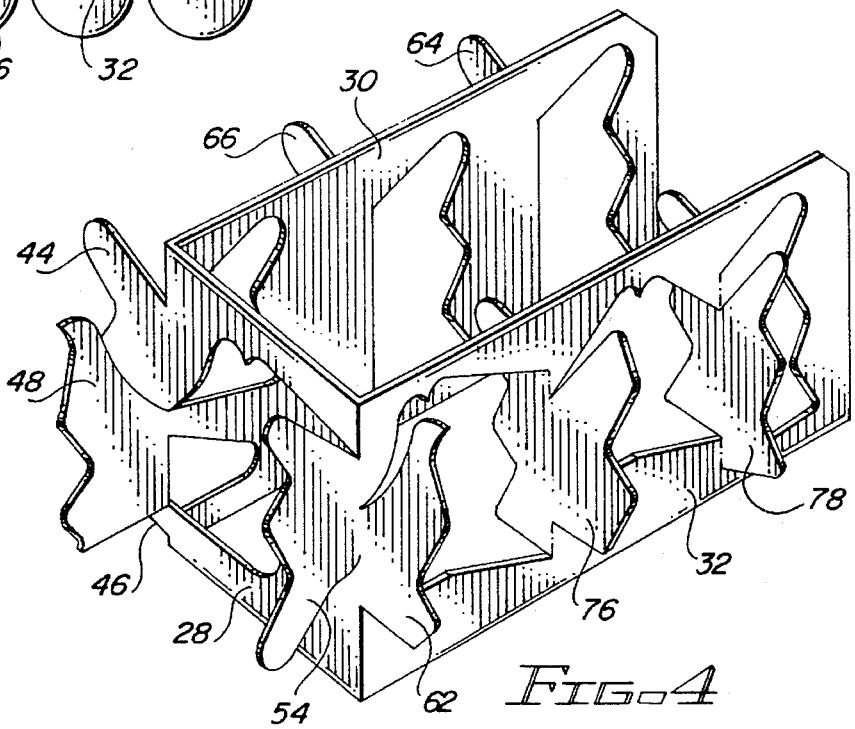
FIG. 4 is a pictorial view of the partition formed from the blank of FIG. 3.

Still referring to FIG. 4 and also to FIG. 5, after the wings of the partition have been fully opened, the partition is inserted into a group of twelve bottles B arranged in three rows of four each. The short partition leg 28 fits between the end bottles of the middle row, while the long partition legs extend between the middle and end rows. The various partition wings extend out from the legs to separate the bottles in each row from each other.

Figure 6:
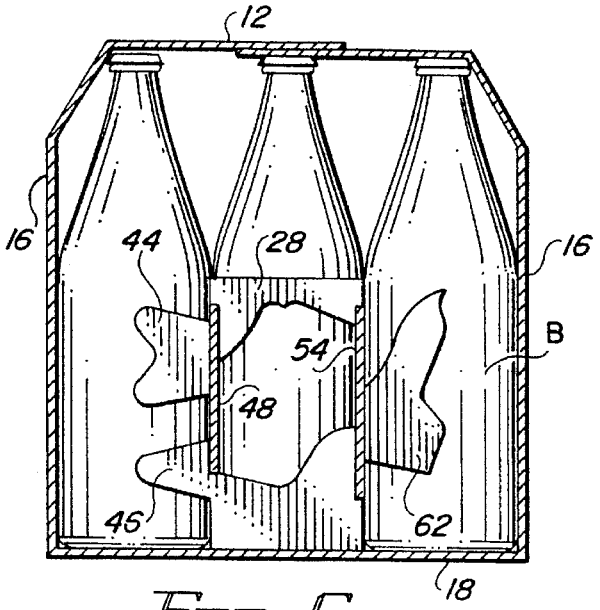
FIG. 6 is a transverse sectional view taken on line 6—6 of FIG. 2, showing the end leg and associated wings of the installed partition.

The particular design of the partition wings will vary according to the shape of the bottles to be packaged and the size and shape of the carton. In order to prevent adjacent bottles from being in contact, the wings should extend out at least to the midpoint, and preferably slightly beyond this point, of the adjacent bottles and should extend up at least to the point of transition from the barrel of the bottles to the bottle necks. This is best seen in FIG. 6. The irregular shape of the side edges of the partition wings allows the wings to extend beyond the midpoint of the bottles. If they were simply straight vertical edges, it will be appreciated that the wings could extend out no farther than halfway between the long partition legs.

The dimensions of the wings at the central section 28 of the blank must also be such that the wings will not tear during forming and insertion. Thus the distance between the fold lines 26A and 26B, which is the minimum width of the partition wing 54, must be enough to resist tearing. The same is true of the distance between the fold lines 26B and 26C, the distance between fold lines 24A and 24B, and the distance between fold lines 24C and 24D. As to the partition wings 44 and 46, it will be seen that they function together as a single wing and are separated only due to the presence of the wing 48. Even though these wings are separated, they extend out far enough to protect the adjacent bottle against contact with the next bottle.

Figure 7:
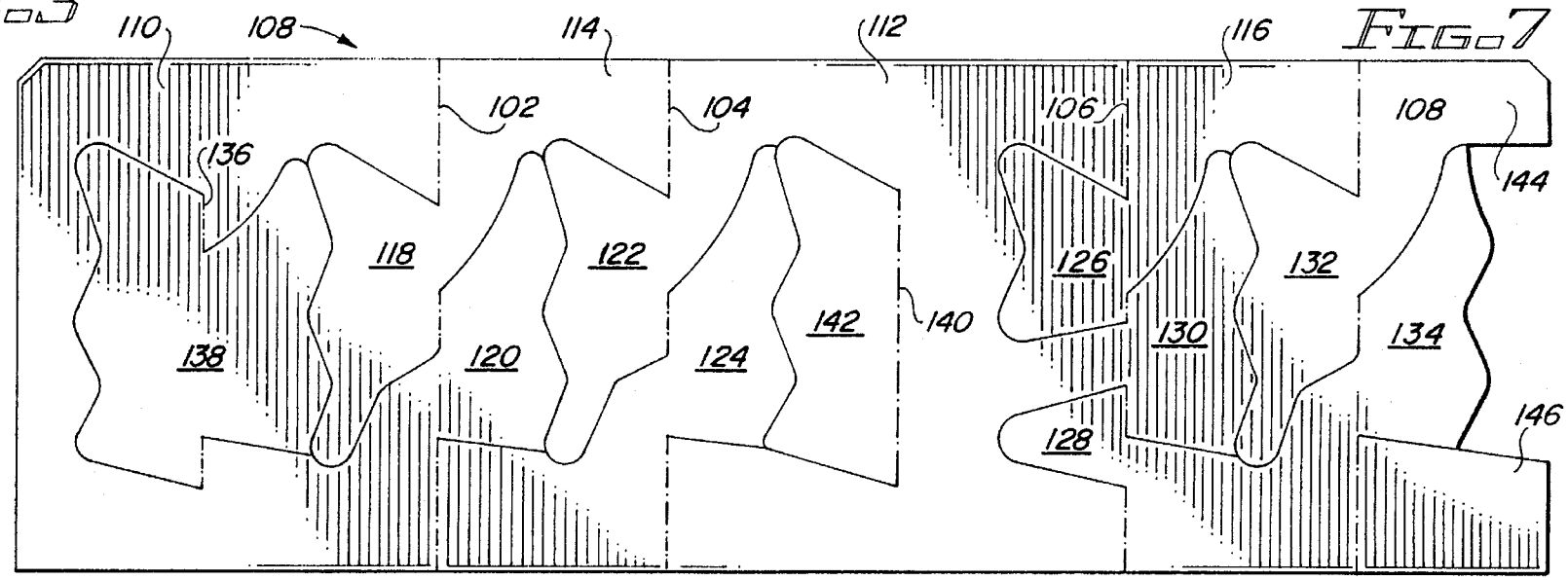
FIG. 7 is a plan view of a blank for forming another embodiment of the partition of the invention.

A modified blank 100 is shown in FIG. 7. This blank is divided by parallel fold lines 102, 104, 106 and 108 into two long partition leg sections 110 and 112 and two short partition leg sections 114 and 116. Segments of these fold lines, with their associated slits, form partition wings 118, 120, 122, 124, 126, 128, 130, 132 and 134. In addition, the segments of fold line 136 form with their associated slits the double partition wing 138, and fold line 140 forms with its associated slit the single partition wing 142. As in the case of the wings 44 and 46 in the blank of FIG. 3, the wings 126 and 128 function as a single unit. The blank also includes upper and lower tabs 144 and 146.

Figure 9:
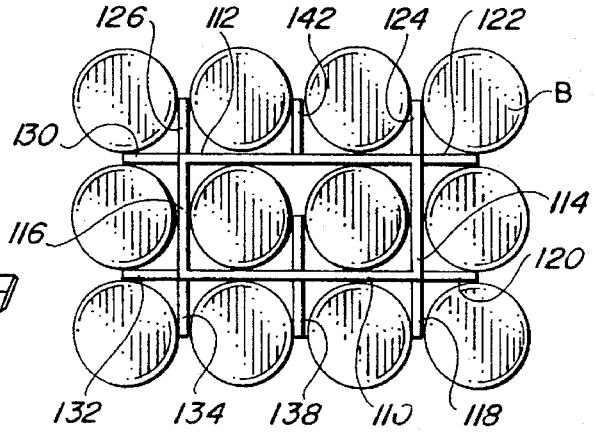
FIG. 9 is a simplified plan view of the arrangement utilizing the partition of FIG. 8 to separate a group of twelve bottles.
Figure 8:
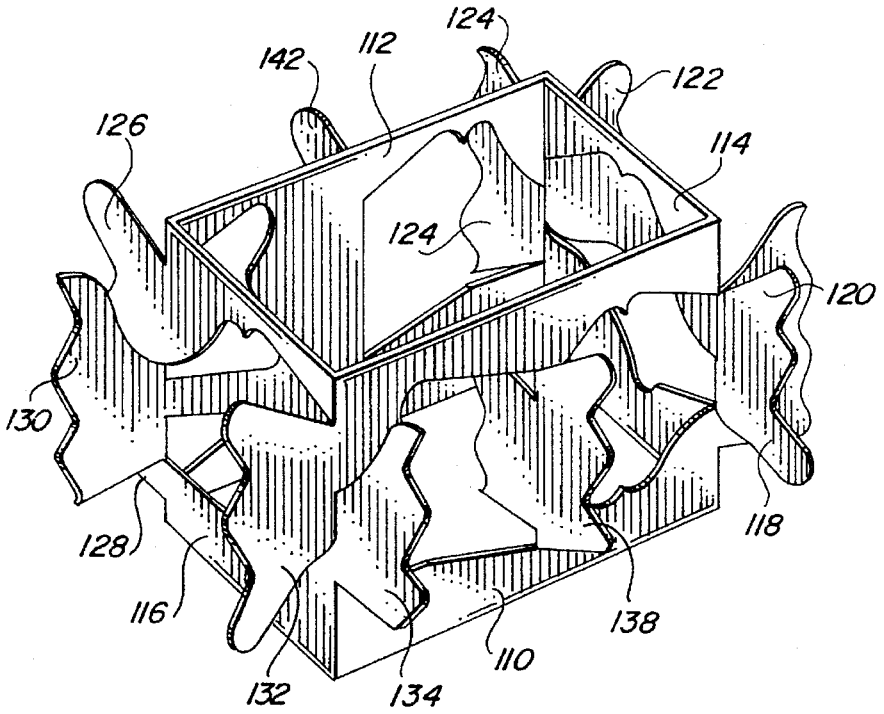
FIG. 8 is a pictorial view of the partition formed from the blank of FIG. 7.

A four-sided partition, shown in FIG. 8, is formed from the blank 100 by folding the blank along the fold lines 102, 104, 106 and 108. This automatically opens the wings 118–134, requiring that only the wings 138 and 142 be opened by an additional folding step. The tabs 144 and 146 lie flat against the inner face of the partition leg 110 and may be adhered to the leg 110 by glue if desired. It is not necessary that they actually be adhered, except as it may facilitate the insertion step, since the partition will be held in place in the package by the pressure of the adjacent bottles on the partition legs and tabs. This arrangement, like the partition of FIG. 4, separates adjacent bottles in the package, but because it has an additional short partition leg, more of the partition wings open automatically than in the partition of FIG. 4. The placement of the various partition legs and wings relative to the bottles is illustrated in FIG. 9. In both designs the amount of paperboard required is substantially the same.

Although described with respect to 12-pack cartons, the invention can be employed with other sizes of cartons. Since each partition provides protection for three rows of bottles, it can be made longer for cartons containing any number of bottles arranged in three rows, or two or more can be utilized for cartons in which the bottles are arranged in multiples of three rows.

It can now be appreciated that the invention has substantial economic benefits over the use of conventional bottle partitions. The partitions themselves are less expensive than conventional partitions inasmuch as the amount of material required for a carrier is substantially less. Because fewer partitions are required to be inserted, fewer inserting sections are required for the packaging machine, which means that the machine can be shorter and less expensive. In addition, the automatic opening of many of the partition wings means that fewer wing opening devices need be provided, thereby further reducing the costs of the machine and the packaging operation.

It will be understood that the invention is not necessarily limited to all the specific details described in connection with the preferred embodiments, but that changes to certain features of the preferred embodiments which do not alter the overall basic function and concept of the invention may be made without departing from the spirit and scope of the invention defined in the appended claims.

What is claimed is:

1. A partition for separating adjacent bottles in a carton, comprising:

two spaced substantially parallel partition legs connected along fold lines to a transverse partition leg;

a partition wing connected to each of the fold lines and extending substantially parallel to the transverse partition leg; and a partition wing connected to each of the fold lines and extending substantially parallel to the spaced partition legs, the partition wings extending substantially parallel to the transverse partition leg being struck from the spaced partition legs, and the partition wings extending substantially parallel to the spaced partition legs being struck from the transverse partition leg.

2. A bottle partition as recited in claim 1, including at least one additional partition wing connected to each spaced partition leg along a fold line and extending substantially parallel to the transverse partition leg.

3. A bottle partition as recited in claim 2, wherein one of the additional partition wings extends both outwardly and inwardly of the partition leg to which it is connected, and the additional partition wing connected to the other partition leg extends outwardly thereof, the additional partition wings lying substantially in the same vertical plane.

4. A bottle partition as recited in claim 3, wherein at least portions of the additional partition wings extend from the partition legs to which the additional partition wings are connected a distance of at least half the distance between the spaced partition legs.

5. A bottle partition as recited in claim 4, wherein at least portions of the partition wings connected to the fold lines connecting the spaced partition legs to the transverse partition leg extend outwardly from said fold lines a distance greater than half the distance between the spaced partition legs.

6. A bottle partition as recited in claim 2, wherein the partition wings extending substantially parallel to the transverse partition leg are struck from the spaced partition legs, and the partition wings extending substantially parallel to the spaced partition legs are struck from the transverse partition leg.

7. In a carton containing at least three rows of bottles, a partition separating adjacent bottles in the rows, comprising:

two spaced substantially parallel partition legs connected along fold lines to a transverse partition leg, one of the spaced partition legs extending between the first and second row of bottles, the other spaced partition leg extending between the second and third row of bottles and the transverse partition leg extending between adjacent bottles in the second row;

a partition wing connected to each of the fold lines and extending substantially parallel to the transverse partition, the partition wing connected to one of the fold lines extending between adjacent bottles in the first row and the partition wing connected to the other fold line extending between adjacent bottles in the third row;

a partition wing connected to each of the fold lines and extending substantially parallel to the spaced partition legs, the partition wing connected to one of the fold lines extending between bottles in the first and second row and the partition wing connected to the other fold line extending between bottles in the first and second row and the partition wing connected to the other fold line extending between bottles in the second and third row; and at least one additional partition wing connected to each spaced partition leg along a fold line and extending substantially parallel to the transverse partition leg, one of the additional partition wings extending both outwardly and inwardly of the partition leg to which it is connected between adjacent bottles in the first and second rows, and the additional partition wing connected to the other partition leg extending outwardly thereof between adjacent bottles in the third row.

8. A bottle partition as recited in claim 7, wherein the partition wings extending substantially parallel to the transverse partition leg are struck from the spaced partition legs, and the partition wings extending substantially parallel to the spaced partition legs are struck from the transverse partition leg.

9. A bottle partition as recited in claim 7, wherein at least portions of the partition wings extend from the partition legs to which they are connected a distance greater than half the distance between the spaced partition legs.

10. A blank for forming a partition for separating adjacent bottles in a carton, comprising:

a relatively short partition section connected on opposite sides by interrupted fold lines to relatively long partition sections;

continuous slits in the relatively long partition sections extending from interrupted portions of the fold lines, the areas enclosed within the continuous slits forming partition wings extending out from the relatively short partition section in a partition formed from the blank;

at least one interrupted fold line in one of the relatively long partition sections, continuous slits extending from interrupted portions of the latter interrupted fold line, the area enclosed within the continuous slits forming additional partition wings extending transversely of said one relatively long partition section on opposite sides thereof in a partition formed from the blank;

at least one continuous fold line in one of the relatively long partition sections, a continuous slit extending from opposite ends of the continuous fold line, the area enclosed within the continuous slit and the continuous fold line forming an additional partition wing extending transversely of said one relatively long partition section in a partition formed from the blank; and continuous slits in the relatively short partition section extending from interrupted portions of the fold lines, the areas enclosed within the continuous slits forming partition wings extending out from the relatively long partition sections in a partition formed from the blank, at least portions of the continuous slits are spaced a maximum distance from the fold lines to which they are connected which is greater than half the distance between the interrupted fold lines connecting the relatively short partition section to the relatively long partition sections.

11. A blank as recited in claim 10, wherein a portion of each continuous slit in the relatively short partition section is a common slit.

* * * * *